US011680733B2

(12) United States Patent
MacCracken et al.

(10) Patent No.: US 11,680,733 B2
(45) Date of Patent: Jun. 20, 2023

(54) STORAGE SOURCE AND CASCADE HEAT PUMP SYSTEMS

(71) Applicant: TRANE INTERNATIONAL INC., Davidson, NC (US)

(72) Inventors: Mark Mitchell MacCracken, Miami Beach, FL (US); Susanna Staubly Hanson, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 168 days.

(21) Appl. No.: 17/138,156

(22) Filed: Dec. 30, 2020

(65) Prior Publication Data

US 2022/0205686 A1 Jun. 30, 2022

(51) Int. Cl.

| | |
|---|---|
| ***F25B 13/00*** | (2006.01) |
| ***F24D 11/02*** | (2006.01) |
| ***F24D 17/02*** | (2006.01) |
| ***F24F 5/00*** | (2006.01) |

(Continued)

(52) U.S. Cl.

CPC ..... *F25B 13/00* (2013.01); *F24D 11/0221* (2013.01); *F24D 17/02* (2013.01); *F24F 5/0046* (2013.01); *F25D 16/00* (2013.01); *F24D 2200/14* (2013.01); *F24F 2005/0025* (2013.01); *F25B 2400/24* (2013.01); *F28D 2020/0078* (2013.01)

(58) Field of Classification Search

CPC ..... F25B 13/00; F24D 17/02; F25D 16/00; F28D 2020/0078

See application file for complete search history.

(56) References Cited

U.S. PATENT DOCUMENTS

| | | | |
|---|---|---|---|
| 4,294,078 | A | 10/1981 | MacCracken |
| 5,497,629 | A | 3/1996 | Rafalovich et al. |
| 5,680,898 | A | 10/1997 | Rafalovich et al. |

(Continued)

FOREIGN PATENT DOCUMENTS

| | | | |
|---|---|---|---|
| EP | 3354996 | A1 | 8/2018 |
| GB | 2578022 | A | 4/2020 |
| WO | 2020/209979 | A2 | 10/2020 |

OTHER PUBLICATIONS

Extended European Search Report issued in European Patent Application No. 21215001.5, dated May 24, 2022 (8 pages).

*Primary Examiner* — Henry T Crenshaw

(74) *Attorney, Agent, or Firm* — Hamre, Schumann, Mueller & Larson, P.C.

(57) ABSTRACT

A heating, ventilation, air conditioning, and refrigeration (HVACR) system includes a heating fluid circuit, a cooling fluid circuit, and a storage fluid circuit. A thermal system of the HVACR system absorbs energy from the storage fluid circuit and rejects it to the heating fluid circuit. The storage fluid circuit includes thermal storage tanks containing thermal storage material that can provide energy for heating or absorb energy for cooling depending on the state of the thermal storage material. Heating can be provided using the heating fluid circuit and the heat provided by the thermal system. Cooling can be provided using the cooling fluid circuit by absorbing energy from the conditioned space using a cooling fluid and rejecting energy from the cooling fluid to the storage fluid circuit. The thermal storage tanks can have heat added to them using an air source heat pump system to support heating operations.

10 Claims, 6 Drawing Sheets

(51) Int. Cl.
*F25D 16/00* (2006.01)
*F28D 20/00* (2006.01)

(56) References Cited

U.S. PATENT DOCUMENTS

| | | | | |
|---|---|---|---|---|
| 6,668,567 | B2 | 12/2003 | Levenduski et al. | |
| 10,487,302 | B2 * | 11/2019 | Spangenburg | C12M 23/06 |
| 10,900,667 | B2 | 1/2021 | Field et al. | |
| 10,907,848 | B2 | 2/2021 | Wallace | |
| 2010/0242517 | A1 * | 9/2010 | Johnson | F25B 30/06 62/260 |
| 2014/0262146 | A1 * | 9/2014 | Cline | F25B 7/00 165/63 |
| 2019/0148946 | A1 * | 5/2019 | Yoshimoto | F24S 60/10 700/286 |
| 2020/0182558 | A1 | 6/2020 | Alsadah et al. | |
| 2020/0393170 | A1 * | 12/2020 | Murphy | F24F 11/30 |
| 2021/0156601 | A1 * | 5/2021 | Melink | F25B 49/02 |
| 2022/0042718 | A1 * | 2/2022 | Liu | F24H 4/04 |

* cited by examiner

STORAGE SOURCE AND CASCADE HEAT PUMP SYSTEMS

FIELD

This disclosure is directed to heat pump systems for heating, ventilation, air conditioning, and refrigeration (HVACR), particularly using thermal storage as a source and/or sink for heat pump operations.

BACKGROUND

Large buildings typically have both heating and cooling needs, even during the winter in cold climates, due to the differing times and locations of heat generation and loss while attempting to maintain temperatures throughout the entire building. Certain areas such as interior portions of the building may require cooling even during cold climate winters, since heat is produced in those spaces but surrounding peripheral spaces are also temperature-controlled. The heating and cooling demands also vary over time, for example, peripheral areas of a building can require significant heating during morning times, but can require cooling at other times, such as when receiving afternoon sun, again even during cold climate winters.

Typically, large buildings tend to meet these needs by combining "free cooling" of hotter spaces such as interior areas or peripheral spaces experiencing afternoon sunlight by rejecting energy to the ambient environment, while also using energy for heating of colder areas such as other peripheral areas through, for example, boilers using fossil fuels to generate heat. Boilers require on-site consumption of fossil fuels and face limitations due to carbon and other pollution emission controls.

SUMMARY

This disclosure is directed to heat pump systems for heating, ventilation, air conditioning, and refrigeration (HVACR), particularly using thermal storage as a source and/or sink for heat pump operations.

By using a heat pump system and thermal storage, waste energy captured during cooling can be used to address the heating demand of a building. The thermal storage can further be provided energy using a heat pump system, allowing the thermal storage to be recharged even when waste energy would not be sufficient to satisfy heating demand by itself. The thermal storage further allows system capacity and energy consumption to be evened out or shifted over time, such that the system can meet building demand while at lower designed capacities, and avoiding energy consumption at peak times where there may be higher cost and/or limited availability of energy.

Heat pump systems removing reliance on boilers can further support electrification efforts, by providing greater efficiency through the increased coefficient of performance (COP) of the heat pump itself compared to a boiler and the increased possibilities regarding energy sources for the heat pump.

Thermal storage using a thermal storage material can store a vast amount of energy for use in heating operations. For a material such as water, the latent energy required for a phase change can be orders of magnitude greater than the energy required to change temperature within a phase, allowing large amounts of thermal energy to be stored by thawing the material so that it can be frozen as energy is pumped out. The large quantity of stored energy can reduce peak capacity needs in system design, allowing for smaller capacity, lower-cost systems to meet building needs. Further, those systems consume less energy when meeting peak demand. The thermal storage can be kept in a desired state at least in part through use of a heat pump adding energy to the thermal storage (i.e. melting ice) from ambient air or any other suitable source when electrical energy is available to operate the heat pump. Thermal storage can also be used to support cooling operations during warm periods, melting ice to supplement or replace cooling provided by a thermal system, combined with making ice during periods of low or no cooling demand by continuing to operate the thermal system.

Use of a heat pump to provide energy to the thermal storage can decouple the collection of thermal energy from its use, allowing operation of, for example, the heat pump to be done at energy and cost-efficient times while the stored thermal energy in the tanks can be used at other times such as when addressing peak demand. By coupling the heat pump to the thermal storage instead of using the heat pump for heating of the building, the range of operating temperatures for the heat pump can be decoupled from the temperature of the thermal system. Since the heat pump only needs to pump energy up to a temperature to melt the thermal storage material, instead of a temperature for satisfying heating demand, this can allow operation of the heat pump at greater efficiencies. Using the thermal storage as an intermediary further allows the flow rates of the thermal system and heat pump or other sources of thermal energy to be decoupled from one another.

In an embodiment, a heating, ventilation, air conditioning, and refrigeration (HVACR) system includes a heating fluid circuit configured to circulate a heating process fluid, the heating fluid circuit configured to provide heat to one or more heating coils distributed within a conditioned space. The HVACR system also includes a cooling fluid circuit configured to circulate a cooling process fluid. The HVACR system further includes a storage fluid circuit configured to circulate a storage circuit process fluid. The storage fluid circuit includes one or more thermal storage tanks each containing a thermal storage material, a heat exchanger allowing heat exchange between the storage circuit process fluid and the cooling circuit process fluid, and a bypass line configured to allow the heat exchanger to be selectively bypassed. The HVACR system further includes a thermal system configured to absorb energy from the storage circuit process fluid and provide energy to the heating circuit process fluid and a source heat exchange circuit including a heat pump configured to absorb energy from a source and provide energy to a source circuit process fluid, the source heat exchange circuit configured such that the heat pump exchanges heat with the one or more thermal storage tanks.

In an embodiment, the thermal storage material is water and the storage circuit process fluid has a freezing temperature that is lower than a freezing temperature of water.

In an embodiment, the source heat exchange circuit is directly connected to the storage fluid circuit and the source circuit process fluid includes a portion of the storage circuit process fluid.

In an embodiment, the source heat exchange circuit includes one or more heat exchangers configured to allow exchange of heat between the source circuit process fluid and the thermal storage material in the one or more thermal storage tanks.

In an embodiment, the storage fluid circuit is configured such that the source heat exchanger can be selectively included or excluded from a flow of the storage circuit process fluid.

In an embodiment, the heating fluid circuit further includes a cooling tower configured to allow the exchange of energy between the heating process fluid and an ambient environment, the heating fluid circuit being configured to selectively include or exclude the cooling tower from a flow of the heating process fluid.

In an embodiment, the storage fluid circuit further includes one or more dedicated outdoor air system (DOAS) heat exchangers, wherein the one or more DOAS heat exchangers are each configured allow the exchange of energy between the storage circuit process fluid and a latent cooling load of the conditioned space, and the storage fluid circuit is configured to selectively include or exclude the one or more DOAS heat exchangers from a flow of the storage circuit process fluid.

In an embodiment, the storage fluid circuit further includes a bypass line configured to allow flow of the storage circuit process fluid to bypass the one or more thermal storage tanks, and a plurality of valves, the plurality of valves configured to control flow through each of the bypass line and the one or more thermal storage tanks.

In an embodiment, the heat pump is configured to produce a leaving temperature of 60° F. or less when operated to provide energy to the source circuit process fluid. In an embodiment, the heat pump is configured to produce a leaving temperature of between 35° F. and 45° F. when operated to provide energy to the source circuit process fluid.

In an embodiment, the HVACR system of claim further includes at least one of a heat exchanger configured to exchange heat between building waste water and one or more of the thermal storage tanks, or a solar collector configured to provide energy to one or more of the thermal storage tanks.

In an embodiment, a method of adjusting air temperatures in a conditioned space includes operating a heating, ventilation, air conditioning, and refrigeration (HVACR) system in one of a heating mode, a heating and cooling mode, or an energy storage mode, or an energy rejection mode. Operating in heating mode includes operating a thermal system to absorb energy from a storage circuit process fluid of a storage fluid circuit and provide energy to a heating process fluid, the storage fluid circuit including one or more thermal storage tanks each containing a thermal storage material and rejecting energy to the conditioned space at one or more heating coils. Operating in the heating and cooling mode includes operating the thermal system to absorb energy from the storage circuit process fluid and provide energy to the heating process fluid, rejecting energy to the conditioned space at the one or more heating coils, exchanging heat between the storage circuit process fluid and a cooling process fluid, and absorbing energy from the conditioned space to the cooling process fluid at one or more cooling coils. Operating in the energy storage mode comprises exchanging heat between the storage circuit process fluid and the cooling process fluid, wherein the cooling process fluid absorbs energy from the conditioned space at the one or more cooling coils and rejects heat to the thermal storage material at the one or more storage tanks. The method further includes operating a heat pump to absorb energy from a source, and providing the energy absorbed from the source to the one or more thermal storage tanks.

In an embodiment, operating the heat pump results in a leaving temperature at the heat pump of 60° F. or less. In an embodiment, operating the heat pump results in a leaving temperature at the heat pump of between 35° F. and 45° F.

In an embodiment, the method further includes adding energy to the thermal storage tank by one or more of absorbing energy from waste water from the conditioned space or absorbing energy from a solar collector.

In an embodiment, operating the heat pump is performed simultaneously with operating in one of the heating mode, the heating and cooling mode, or the energy storage mode.

In an embodiment, operating the heat pump is performed based on an availability of energy and a capacity of the thermal storage tanks.

In an embodiment, the energy absorbed from the source is provided solely to the thermal storage tanks.

In an embodiment, operating the heat pump adds the energy absorbed from the source to at least a portion of the storage circuit process fluid.

In an embodiment, operating the heat pump adds the energy absorbed from the source to a source circuit process fluid, and the providing of the energy to the one or more thermal storage tanks includes exchanging heat between the source circuit process fluid and the thermal storage material.

DRAWINGS

DETAILED DESCRIPTION

This disclosure is directed to heat pump systems for heating, ventilation, air conditioning, and refrigeration (HVACR), particularly using thermal storage as a source and/or sink for heat pump operations.

Figure 1:
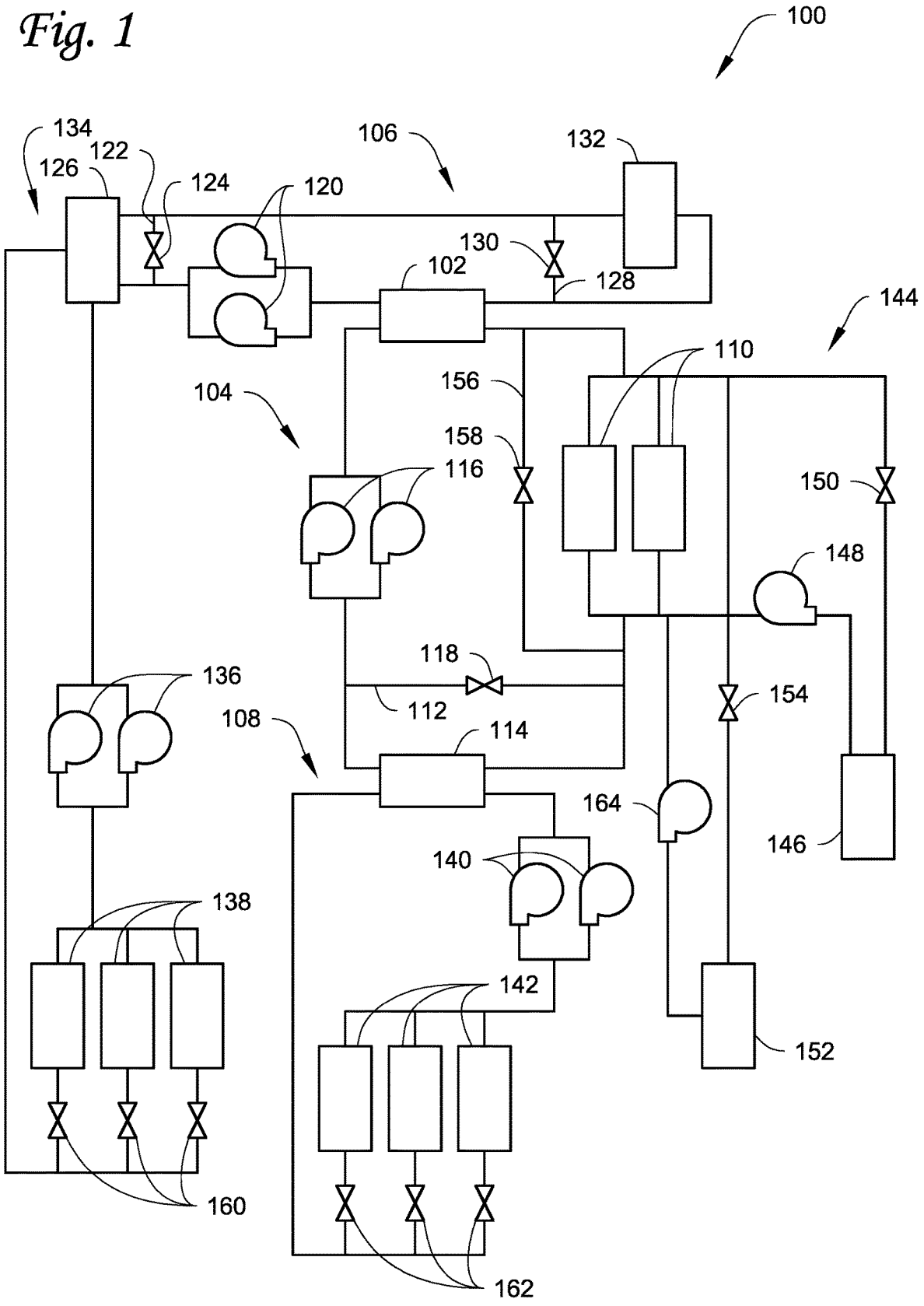
FIG. 1 shows a schematic of a storage source heat pump system according to an embodiment.

FIG. 1 shows a schematic of a storage source heat pump system according to an embodiment. Storage source heat pump system 100 includes a thermal system 102, a storage fluid circuit 104, a heating fluid circuit 106, and a cooling fluid circuit 108. Storage source heat pump system 100 can be used as an HVACR system for a conditioned space such as a building.

Thermal system 102 is a system configured to absorb energy from fluid in storage fluid circuit 104 and provide energy to the fluid of heating fluid circuit 106. Thermal system 102 can be, for example, a heat recovery chiller system. Thermal system 102 can use vapor compression cycles to absorb energy at one location such as, for example, the storage fluid circuit 104 and reject the energy at another, such as the heating fluid circuit 106. Thermal system 102 can include one or more working fluid circuits. The working fluid circuits can each include one or more compressors to compress a working fluid such as a refrigerant, a first heat exchanger where energy is provided to the fluid of heating fluid circuit 106, an expander, and a second heat exchanger where energy is absorbed from the fluid of storage fluid circuit 104. The one or more compressors can include any of, as non-limiting examples, screw compressors, scroll compressors, or centrifugal compressors. The capacity of the thermal system 102 can be selected based on requirements for conditioning a particular space, such as the size of a building, typical ranges of ambient temperatures, and the like. The capacity can be based on a peak load at highest demand, such as summer afternoon cooling, winter morning heating, or the like.

Storage fluid circuit 104 is a fluid circuit configured to circulate a storage circuit process fluid. The storage fluid circuit 104 includes one or more thermal storage tanks 110, a bypass line 112, a heat exchanger 114, and one or more pumps 116.

The thermal storage tanks 110 are one or more tanks each containing a thermal storage material. In an embodiment, the thermal storage material can be a phase change material. The phase change material can be any suitable material having a phase transition, such as liquid to solid, at a known temperature suitable for storage and release of energy at typical system operating conditions. In an embodiment, the thermal storage material includes water. In an embodiment, the thermal storage material is water. In an embodiment, the thermal storage tanks 110 are stratified chilled water tanks. Each of the thermal storage tanks 110 is configured to allow the exchange of energy between the thermal storage material contained therein and at least some of the storage circuit process fluid being circulated through storage fluid circuit 104. The thermal storage tanks 110 can be in series or parallel with one another with respect to the flow of the storage circuit process fluid through storage fluid circuit 104. Thermal storage tanks 110 can be sized based on expected building demand and the thermal storage capacity of the particular thermal storage material being used, such as the latent energy of freezing the thermal storage material. In an embodiment, thermal storage tanks 110 can be bypassed by a thermal storage bypass line 156, through which flow can be controlled by thermal storage bypass valve 158. Thermal storage tanks 110 can further be configured to capture energy from sources that are at temperatures above the temperature of the thermal storage material, such as by absorbing energy from flows of waste water, receiving energy from low-temperature solar collectors, absorbing energy from ambient air by way of heat exchangers when ambient temperatures are above the phase change temperature, or from any other suitable potential source of energy at a temperature above the temperature of the thermal storage material. The energy in these sources can be absorbed passively by way of the natural flow of energy from a higher temperature to a lower temperature. In an embodiment, the sources can be any suitable source at a temperature above a phase change temperature of the thermal storage material, when the thermal storage material is a phase change material.

Bypass line 112 is a fluid line configured to convey storage circuit process fluid from thermal storage tanks 110 to pumps 116 without passing through heat exchanger 114. Flow to or through bypass line 112 can be controlled by one or more valves 118, such as a three-way valve located where bypass line 112 branches off to bypass the heat exchanger 114 or one or more ordinary valves, such as a valve along bypass line 112 and/or a valve located between where bypass line 112 splits off, and heat exchanger 114. Bypass line 112 can thus be selectively included or excluded from the storage fluid circuit 104. Bypass line 112 can be used to bypass heat exchanger 114 when the storage source heat pump system 100 is not providing cooling. Bypass line 112 can be excluded from storage fluid circuit when the storage source heat pump system 100 is providing cooling, such that the storage circuit process fluid enters and absorbs energy at heat exchanger 114.

Heat exchanger 114 is a heat exchanger allowing for exchange of energy between the storage circuit process fluid and a cooling circuit process fluid that is circulated through the cooling fluid circuit 108. At heat exchanger 114, storage circuit process fluid passing through heat exchanger 114 absorbs energy from cooling circuit process fluid. The heat exchanger 114 can be selectively included or excluded from the storage fluid circuit 104 by valves 118 and bypass line 112 based on operating mode of the storage source heat pump system.

Pumps 116 are one or more pumps configured to drive flow of the storage circuit process fluid through storage fluid circuit 104. Pumps 116 can be in series or in parallel with respect to flow through the storage fluid circuit 104. The number and size of the pumps 116 can be selected to meet flow demands for a particular storage source heat pump system. In an embodiment, pumps 116 can provide a variable flow rate. In this embodiment, the flow rate can be varied based on operating conditions of the storage source heat pump system 100 such as operating mode, load, and/or any other suitable basis for setting flow rate through the storage fluid circuit 104.

In an embodiment, the storage circuit process fluid can be a fluid that remains in a fluid state both above and below the temperature at which the thermal storage material in thermal storage tanks 110 changes phase. In an embodiment, the storage circuit process fluid can be primarily or entirely a different material from the thermal storage material. For example, the storage circuit process fluid can be glycol when the thermal storage material is water. In embodiments, the storage circuit process fluid can be primarily the same as the thermal storage material but treated to alter its freezing point to be below that of the thermal storage material. For example, the storage circuit process fluid can water treated with or mixed with other materials to reduce its freezing point below that of the water used as the thermal storage material in thermal storage tanks 110. In an embodiment, thermal storage tanks 110 can further be configured to absorb energy from any other sources at suitable temperatures for adding energy to the thermal storage material. Examples of such sources include building waste water, thermal collectors such as solar collectors, and the like.

Heating fluid circuit 106 is a fluid circuit configured to circulate a heating process fluid. Heating fluid circuit 106 includes pumps 120, optionally a heat exchanger bypass line 122 and a heat exchanger bypass valve 124, heat exchanger 126, optionally a cooling tower bypass line 128 and a cooling tower bypass valve 130, and a cooling tower 132. Heat exchanger 126 exchanges energy with a heating system 134 including one or more pumps 136 and one or more heating coils 138 located in a conditioned space.

Pumps 120 are one or more pumps configured to drive flow of the heating process fluid through heating fluid circuit 106. Pumps 120 can be in series or in parallel with respect to flow through the heating fluid circuit 106. The number and size of the pumps 120 can be selected to meet flow demands for a particular storage source heat pump system 100. In an embodiment, pumps 120 can provide a variable flow rate. In this embodiment, the flow rate can be varied based on operating conditions of the storage source heat pump system 100 such as heating demand, heat output from thermal system 102, and/or any other suitable basis for setting flow rate through the heating fluid circuit 106.

Heat exchanger bypass line 122 is a fluid line in parallel with heat exchanger 126, allowing heat exchanger 126 to be bypassed by heating process fluid circulating through heating fluid circuit 106. Heat exchanger bypass valve 124 can be one or more valves controlling flow through one or both of heat exchanger bypass line 122. In an embodiment, heat exchanger bypass valve 124 is a three-way valve. In an embodiment, heat exchanger bypass valve 124 can instead be separate two-way valves respectively controlling flow to heat exchanger 126 and to heat exchanger bypass line 122.

Heat exchanger 126 is a heat exchanger configured to allow the heating process fluid to provide energy to a fluid circulated in a heating system 134. The heating system 134 can then circulate its own fluid to one or more heating coils 138. The heating coils 138 can be distributed in the conditioned space. Valves 160 can be provided to control flow through individual heating coils 138 or groups thereof. Flow to each of the heating coils 138 can be controlled, for example based on local temperatures and/or temperature set points at or near each of or a group of the heating coils 138. Flow through heating system 134 from heat exchanger 126 to heating coils 138 and back can be driven by one or more pumps 136 included in heating system 134. The one or more pumps can be selected and/or operated based on heating demand. Thus, heating fluid circuit 106 can provide energy to heating coils 138 by way of providing energy to heating system 134.

Heating fluid circuit 106 can further include a cooling tower 132. Cooling tower bypass line 128 is a fluid line that is in parallel with cooling tower 132 and can allow fluid to circulate through heating fluid circuit 106 without passing through cooling tower 132. Cooling tower bypass valve 130 can be one or more valves that control flow through one or both of cooling tower bypass line 128 and cooling tower 132. Cooling tower bypass valve 130 and cooling tower bypass line 128 allow cooling tower 132 to be selectively included or excluded in the flow path of heating process fluid as it circulates through heating fluid circuit. Cooling tower bypass valve 130 can include, for example, a three-way valve, two or more two-way valves, or any other suitable arrangement of flow controls for directing flow to either cooling tower 132 or cooling tower bypass line 128. Cooling tower 132 includes one or more heat exchangers configured such that the heating process fluid can provide energy to an ambient environment. In an embodiment, cooling tower 132 can include one or more fans, and the ambient environment can be air driven through the cooling tower 132 by the one or more fans. Cooling tower 132 can allow heating process fluid to give off energy without adding the energy to the conditioned space. This can be used in some operating modes of storage source heat pump system 100, for example during an energy rejection mode where thermal system 102 is being operated to freeze thermal storage material in thermal storage tanks 110, but when there is no heating demand in the conditioned space, such as during summer operations.

Cooling fluid circuit 108 is a fluid circuit configured to circulate a cooling process fluid. Cooling fluid circuit includes pumps 140 and one or more cooling coils 142 located in the conditioned space. Cooling fluid circuit also includes an opposite side of heat exchanger 114 from the side of heat exchanger 114 that the storage circuit process fluid passes through.

Pumps 140 are one or more pumps configured to drive flow of the cooling process fluid through cooling fluid circuit 108. Pumps 140 can be in series or in parallel with respect to flow through the cooling fluid circuit 108. The number and size of the pumps 140 can be selected to meet flow demands for a particular cooling fluid circuit 108. In an embodiment, pumps 140 can provide a variable flow rate. In this embodiment, the flow rate can be varied based on operating conditions of the storage source heat pump system 100 such as cooling load and/or any other suitable basis for setting flow rate through the cooling fluid circuit 108.

At heat exchanger 114, the cooling process fluid provides energy to the storage circuit process fluid. Cooling process fluid passes through cooling fluid circuit 108 to one or more cooling coils 142, where the cooling process fluid absorbs energy from the conditioned space to provide cooling. The flow of cooling process fluid to each cooling coil 142 can be controlled based on local temperatures, different cooling set points for different portions of the conditioned space, and the like. Valves 162 can be used to control flow through individual cooling coils 142 or groups thereof. The flow of cooling process fluid to each cooling coil 142 can be according to any suitable method for controlling flow in chilled water cooling systems.

Air source heat pump circuit 144 can be included in storage source heat pump system 100. Air source heat pump circuit 144 includes an air source heat pump 146, pump 148, and valves 150. Air source heat pump circuit 144 is configured to absorb energy from an ambient environment and to provide that absorbed heat to the thermal storage tanks 110. In an embodiment, air source heat pump circuit 144 is configured to exchange heat only with the ambient environment at air source heat pump 146 and with the thermal storage tanks 110. In an embodiment, air source heat pump 146 can be replaced with a heat pump using any suitable source from which energy can be absorbed that is available for use in the environment storage source heat pump system 100 is installed into. In an embodiment, air source heat pump 146 can instead be a ground source heat pump, for example. In an embodiment, air source heat pump circuit 144 does not exchange heat with any component of heating fluid circuit 106 or cooling fluid circuit 108. In an embodiment, air source heat pump circuit 144 is configured to circulate at least a portion of the storage circuit process fluid and be selectively included in storage fluid circuit 104. In an embodiment, air source heat pump circuit is a separate circuit configured to circulate its own process fluid to absorb energy from air source heat pump 146 and reject it only to the thermal storage material at thermal storage tanks 110. In an embodiment, air source heat pump circuit 144 does not directly allow the exchange of energy with either the heating process fluid or the cooling process fluid. Energy is absorbed from an ambient environment by heat pump 146 and provided to a fluid used to convey the energy to the thermal storage tanks 110. Pump 148 can be one or more pumps configured to drive flow of the fluid used to convey the heat to thermal storage tanks 110. Valves 150 are provided to allow the air source heat pump circuit 144 to be selectively include or excluded from providing energy to thermal storage tanks 110, for example based on the operating mode of the storage source heat pump system 100. Valves 150 can be closed to isolate the air source heat pump circuit 144 from thermal storage tanks 110, for example when the air source heat pump 146 is not being operated. Valves 150 can be opened to allow the fluid passing through air source heat pump circuit to allow the exchange of energy with thermal storage tanks 110 when desired so that energy absorbed at air source heat pump 146 can be added to thermal storage tanks 110.

Air source heat pump circuit 144 can be selectively operated, for example based on one or more of whether the storage source heat pump system 100 is being used to heat, cool, or heat and cool the conditioned space, the availability and/or cost of power, current and/or desired capacity levels in the thermal storage tanks 110, and/or other such factors. In an embodiment, availability of power can be determined based on energy thresholds or limits on available power, and power required for operation in the heating or heating and cooling mode based on demand by the conditioned space. In an embodiment, cost of energy can be accounted for, for example, where there is dynamic pricing for peak versus off-peak energy consumption. In this embodiment, operation of air source heat pump circuit 144 can be determined in part to increase the proportion of energy consumption occurring during off-peak conditions. In an embodiment, operation of air source heat pump circuit 144 can be scheduled to shift energy demand for storage source heat pump system 100 away from peak energy consumption hours and towards off-peak hours. In an embodiment, desired capacity can be based on predicted ambient conditions such as temperature and/or solar forecasts. In an embodiment, desired capacity can be based on historical demand data. In an embodiment, desired capacity can be based on a predetermined period of time, such as one or more days or weeks. Operation of air source heat pump circuit 144 can be controlled to cease operations and thus not consume power when thermal storage tanks 110 are storing a sufficient quantity of energy for upcoming operations of the storage source heat pump system 100. In an embodiment, air source heat pump circuit 144 can be installed into an existing system as part of a retrofitting for electrification of the existing system, by adding the air source heat pump 146 and adding proper piping to allow fluid from air source heat pump 146 to exchange heat with thermal storage tanks of the system.

Air source heat pump 146 can be operated to pump energy into a fluid that is close to the phase change temperature of the thermal storage material in thermal storage tanks 110. Air source heat pump 146 can be a heat pump circuit including a compressor for compressing an air source heat pump working fluid, a first heat exchanger for exchanging heat between the air source heat pump working fluid and the fluid in which the energy is pumped, an expander, and a second heat exchanger for exchanging heat between the air source heat pump working fluid and an ambient environment. Air source heat pump 146 may operate with a leaving fluid temperature that is insufficient to provide heating to the conditioned space directly. In an embodiment, a leaving fluid temperature from air source heat pump 146 when air source heat pump 146 is operating to heat the fluid can be 60° F. or less. In an embodiment, the leaving fluid temperature from air source heat pump 146 when air source heat pump 146 is operating to heat the fluid can be 50° F. or less. In an embodiment, the leaving fluid temperature from air source heat pump 146 when air source heat pump is operating to heat the fluid can be between approximately 40° F. and 45° F. By pumping energy to a fluid at such a relatively low temperature, air source heat pump 144 can be operated efficiently even at low temperatures for the ambient air. In an embodiment, air source heat pump 146 can be operated in reverse such that it absorbs energy from the fluid and rejects the energy to the source. Air source heat pump 146 can be operated in the reverse mode to prepare thermal storage tanks 110 for periods of high cooling demand or support storage source heat pump system 100 during cooling operations. It is understood that air source heat pump 146 can be replaced with a heat pump using any other suitable source available based on building location, configuration, local regulations, and the like, such as ground source heat pumps, heat pumps using an aquifer as a source, or the like.

In an embodiment, the storage source heat pump system 100 can further include one or more dedicated outdoor air system (DOAS) coils 152. The DOAS coils 152 can be included in the storage fluid circuit 104, allowing exchange of energy between the storage circuit process fluid and latent loads for conditioning the space, such as latent cooling loads. In an embodiment, the latent cooling load is for dehumidification of air in or being supplied to the conditioned space. In an embodiment where DOAS coils 152 are used to satisfy latent cooling loads, the cooling fluid circuit 108 can be operated at relatively higher temperatures, allowing temperatures to be maintained at relatively more efficient levels for providing the cooling to meet the sensible loads (i.e. adjusting the actual temperatures within the conditioned space). Flow to the portion of storage fluid circuit 104 including the DOAS coils 152 can be controlled using one or more valves 154. Flow through this portion of the storage fluid circuit can be driven at least in part by one or more pumps 164.

Figure 2:
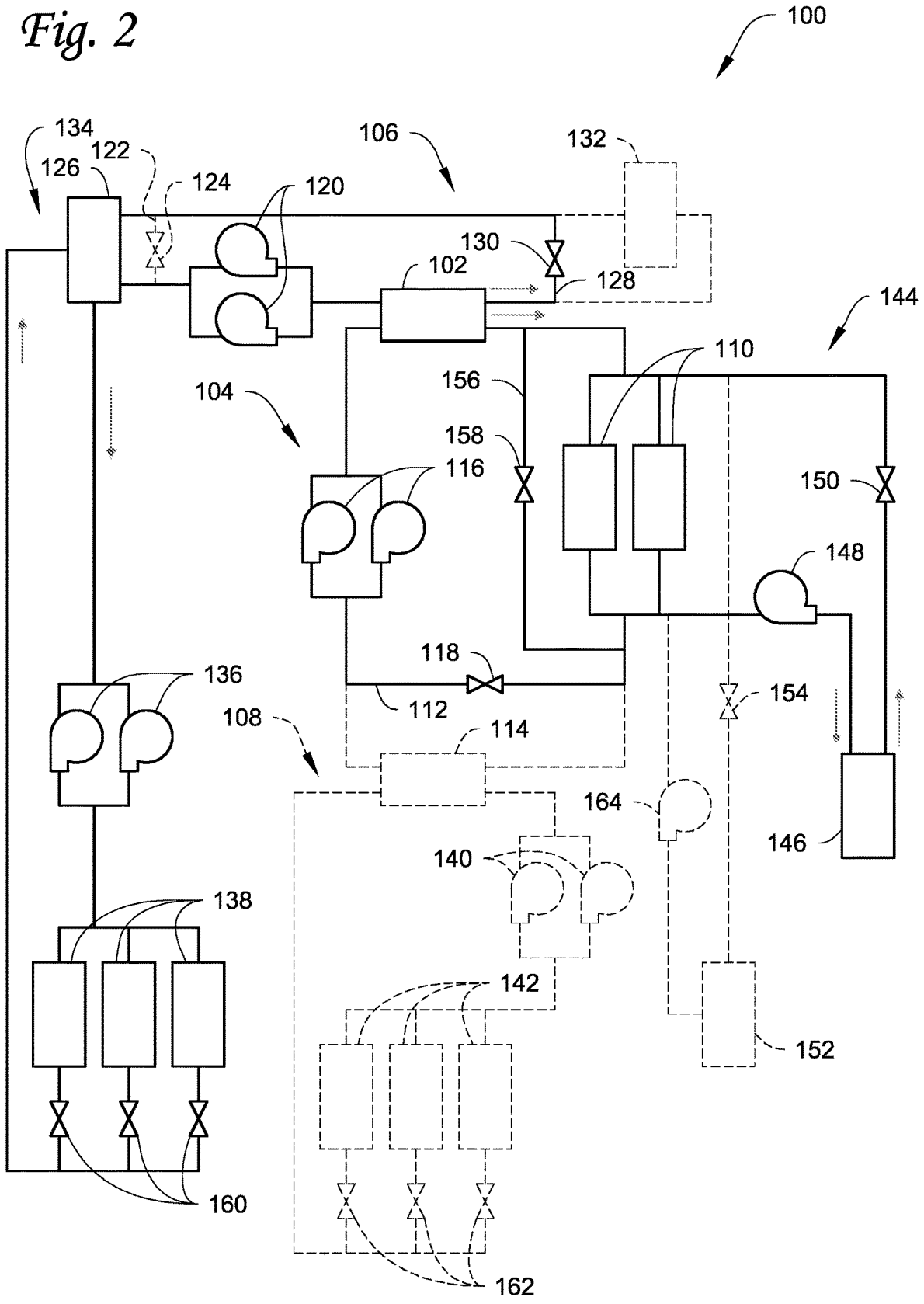
FIG. 2 shows a schematic of the storage source heat pump system of FIG. 1 in a heating mode.

FIG. 2 shows a schematic of the storage source heat pump system of FIG. 1 in a heating mode. In the heating mode shown in FIG. 2, thermal system 102 is being operated such that it rejects heat to the heating process fluid circulating in heating fluid circuit 106 and absorbs energy from the storage circuit process fluid circulating in storage fluid circuit 104. In storage fluid circuit 104, the storage fluid circuit absorbs energy at thermal storage tanks 110, causing thermal storage material to solidify. The storage circuit process fluid can be at a temperature below the freezing point of the thermal storage material when it begins exchanging energy with the thermal storage material at thermal storage tanks 110, for example being at or about 25° F. where it enters thermal storage tanks 110, in order to absorb energy by freezing some of the thermal storage material. In the heating fluid circuit 106, the heating process fluid circulates between thermal system 102 and heat exchanger 126. Heating fluid circuit excludes cooling tower 132 using cooling tower bypass line 128 and cooling tower bypass valve 130 to avoid circulating fluid to cooling tower 132. At heat exchanger 126, the heating process fluid provides energy to the fluid of heating system 134, which then heats the space by rejecting energy to the conditioned space at heating coils 138. In the heating mode, thermal system 102 thus acts as a heat pump, pumping stored energy out of the thermal storage tanks 110 by solidifying the thermal storage material, with the energy being pumped into the heating process fluid, which in turn is used to provide heat to heating coils 138 and thus to the conditioned space.

The heating mode can optionally also include operation of air source heat pump circuit 144 to add heat to the thermal storage tanks 110 or reduce the absorption of heat from the thermal storage tanks 110. When the air source heat pump circuit 144 is operated, air source heat pump 146 operates to absorb energy from the source and provide energy to a fluid that exchanges energy with thermal storage tanks 110, such as the storage circuit process fluid. The air source heat pump can be operated to provide the fluid at a temperature that is greater than the freezing point of the thermal storage material. The temperature of the fluid can be a temperature readily attainable based on the temperature of the source, for example at or about 42° F. when provided to the thermal storage tanks 110. In an embodiment, the fluid is the storage circuit process fluid, and is mixed with the storage circuit process fluid from thermal system 102 prior to exchange of heat with thermal storage tanks 110. In an embodiment, the heating mode shown in FIG. 2 can include operation of the air source heat pump circuit 144 when the heating mode is not at a full system energy consumption.

In the heating only mode shown in FIG. 2, the cooling circuit 108 is inactive, with heat exchanger 114 being bypassed in the storage fluid circuit 104. If present as a part of the system, the optional DOAS coils 152 also are excluded in operation from the storage fluid circuit 104.

Figure 3:
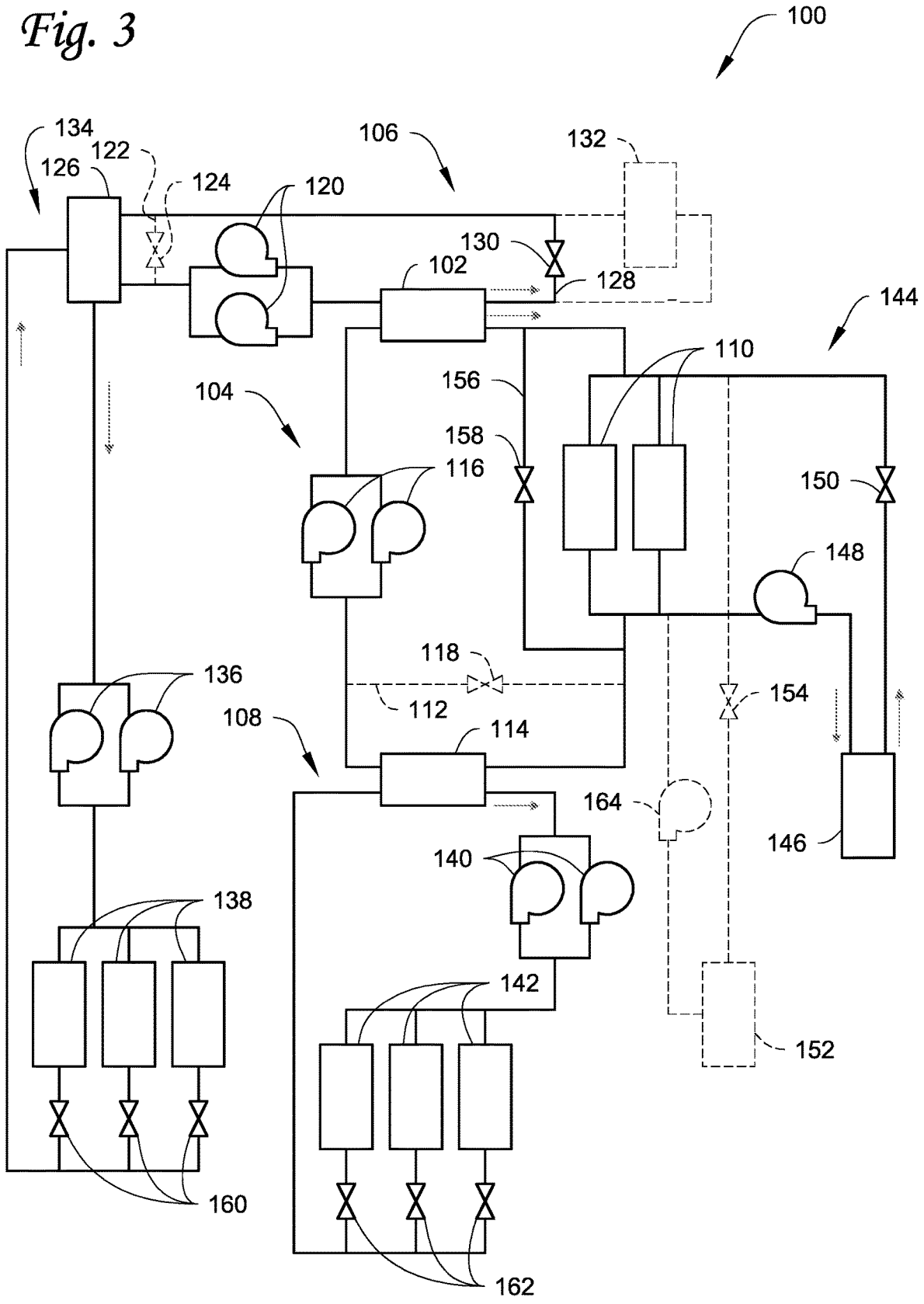
FIG. 3 shows a schematic of the storage source heat pump system of FIG. 1 in a heating and cooling mode.

FIG. 3 shows a schematic of the storage source heat pump system of FIG. 1 in a heating and cooling mode. In the heating and cooling mode shown in FIG. 3, thermal system 102 absorbs energy from storage fluid circuit 104 and provides energy to heating fluid circuit 106. In storage fluid circuit 104, heat exchanger 114 is included, allowing the storage circuit process fluid to absorb energy from the cooling process fluid in cooling fluid circuit 108, as well as from the thermal storage material in storage tanks 110. Flow through storage tanks 110 and the heat exchanger 114 can each be controlled to ensure satisfaction of the cooling demand while providing proper temperatures at the inlet of thermal system 102 for efficient operation while satisfying heating demand.

The heating and cooling mode shown in FIG. 3 can optionally also include operation of air source heat pump circuit 144 to add energy to the thermal storage tanks 110 or reduce the rate of absorption of energy from the thermal storage tanks 110. When the air source heat pump circuit 144 is operated, air source heat pump 146 operates to absorb energy from the source and provide energy to a fluid that exchanges energy with thermal storage tanks 110, such as the storage circuit process fluid. The air source heat pump can be operated to provide the fluid at a temperature that is greater than the freezing point of the thermal storage material. The temperature of the fluid can be a temperature readily attainable based on the temperature of the source, for example at or about 42° F. when provided to the thermal storage tanks 110. In an embodiment, the fluid is the storage circuit process fluid, and is mixed with the storage circuit process fluid from thermal system 102 prior to exchange of energy with thermal storage tanks 110. In the heating and cooling mode shown in FIG. 3, the optional DOAS coils 152 can be excluded from operation of the storage fluid circuit 104. As in the heating mode shown in FIG. 2 and described above, cooling tower 132 can be excluded from operation of the cooling fluid circuit 106 such that energy absorbed by the heating process fluid is rejected primarily at heat exchanger 126.

In the heating and cooling mode, only select heating coils 138 and cooling coils 142 can be used to provide heating and cooling, respectively, to the conditioned space. In an embodiment, heating and cooling demands can occur simultaneously due to building thermal characteristics, different activities by region, or any other suitable reason for both heating and cooling to be needed at different points within the conditioned space. The selection of active heating coils 138 and cooling coils 142 and/or flow to those coils can be based on the relative heating or cooling at or near each of the respective heating coils 138 and/or cooling coils 142. For example, cooling coils 142 closer to a center of a building can be used to address cooling needs in those locations, while heating coils at or closer to a periphery of the building can be used to address heating demands in those regions. In an embodiment, heating and cooling can be performed simultaneously due to differences in local temperature set points, such as different thermostat settings in different portions of the conditioned space. In the heating and cooling mode, energy rejected to the cooling process fluid can be used to support heating of the heating process fluid at thermal system 102 and/or stored in thermal storage tanks 110 by supporting the melting of the thermal storage material. In an embodiment, in the heating and cooling mode, no cooling tower such as cooling tower 132 is used to provide cooling to the conditioned space.

Figure 4:
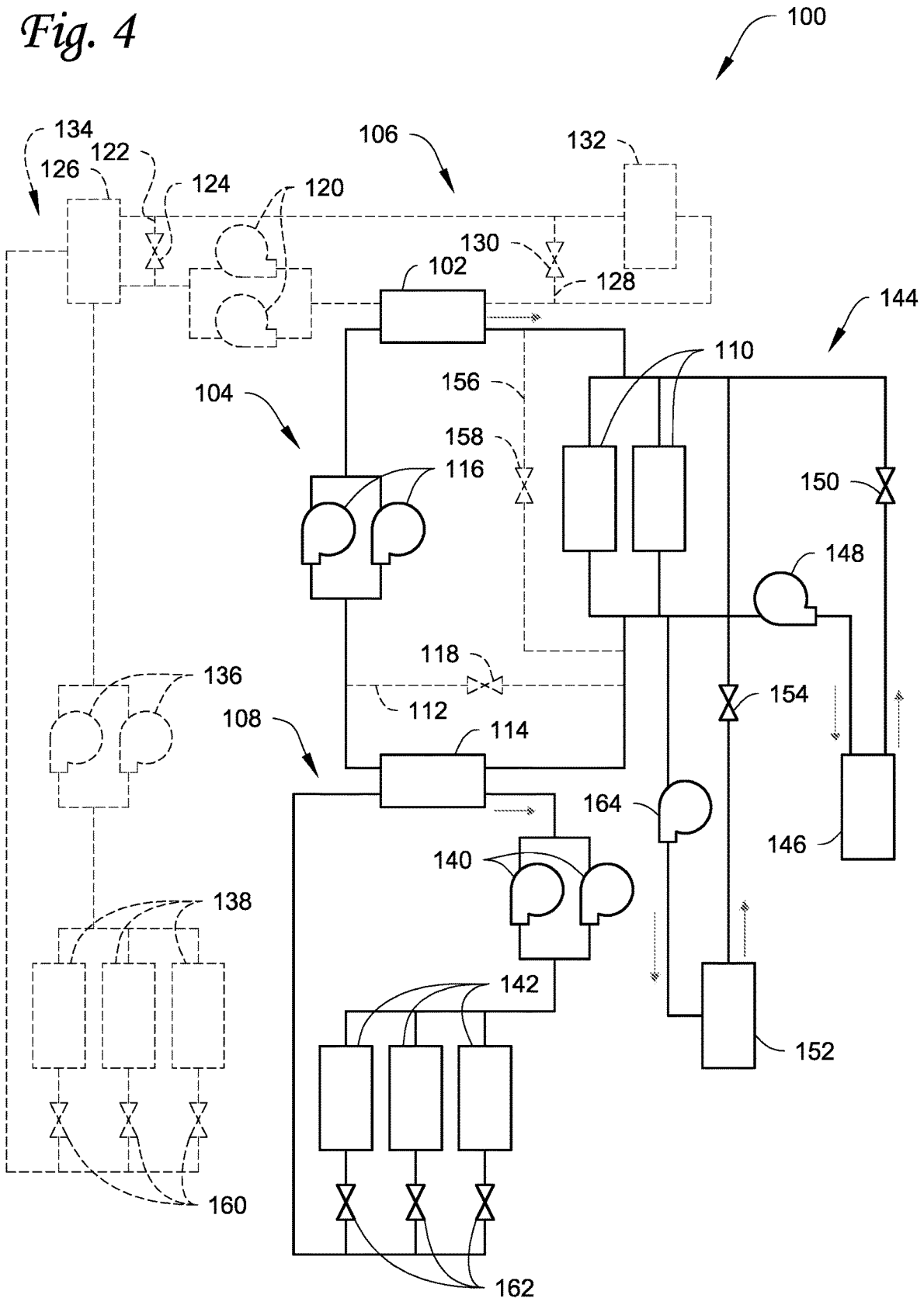
FIG. 4 shows a schematic of the storage source heat pump system of FIG. 1 in an energy storage mode.

FIG. 4 shows a schematic of the storage source heat pump system of FIG. 1 in an energy storage mode. The energy storage mode shown in FIG. 4 can include cooling during winter or other periods where there can be heating demand and thus storage of energy in thermal storage tanks 110 as liquid water is desirable. In the energy storage mode shown in FIG. 4, the storage fluid circuit includes heat exchanger 114 and thermal storage tanks 110, such that the storage circuit process fluid absorbs energy at heat exchanger 114 and provides energy to the thermal storage tanks 110. The storage circuit process fluid can be above a freezing point of the thermal storage material in thermal storage tanks 110. Thermal system 102 can be deactivated or operated based on discharge requirements, shutdown-startup procedures for the thermal system 102, or the like. Heating fluid circuit 106 is inactive in the energy storage mode shown in FIG. 4.

In the energy storage mode shown in FIG. 4, storage of energy in the thermal storage tanks 110 by melting the thermal storage material can further be supported by operation of air source heat pump system 144. When the air source heat pump circuit 144 is operated, air source heat pump 146 operates to absorb energy from the source and provide energy to a fluid that exchanges energy with thermal storage tanks 110, such as the storage circuit process fluid. The air source heat pump can be operated to provide the fluid at a temperature that is greater than the freezing point of the thermal storage material. The temperature of the fluid can be a temperature readily attainable based on the temperature of the source, for example at or about 42° F. when provided to the thermal storage tanks 110. In an embodiment, the fluid is the storage circuit process fluid, and is mixed with the storage circuit process fluid from heat exchanger 114 prior to exchange of energy with thermal storage tanks 110.

By relying on the thermal storage to meet cooling demand when in the energy storage mode shown in FIG. 4, instead of using a cooling tower, waste energy produced within the conditioned space can be stored in thermal storage tanks 110 in anticipation of subsequent heating operations, instead of merely being discharged to an ambient environment. Further, operation of the air source heat pump system 146 can be controlled to add a known quantity of energy to thermal storage tanks 110, based, for example, on the expected demand during a predetermined period of time, such as the next day or the next week. This can prevent excessive operation of the air source heat pump system 146 and conserve energy by deactivating the air source heat pump system 146 when energy goals have been satisfied. In an embodiment, the operation time of air source heat pump system 146 can be optimized based on a desired quantity of energy to add to the thermal storage tanks 110 and parameters affecting the cost or efficiency of adding that energy to the thermal storage tanks, such as predicted ambient temperatures over time, rate information including dynamic rate adjustments for electrical power, time needed to add the desired quantity of energy, and the like.

Figure 5:
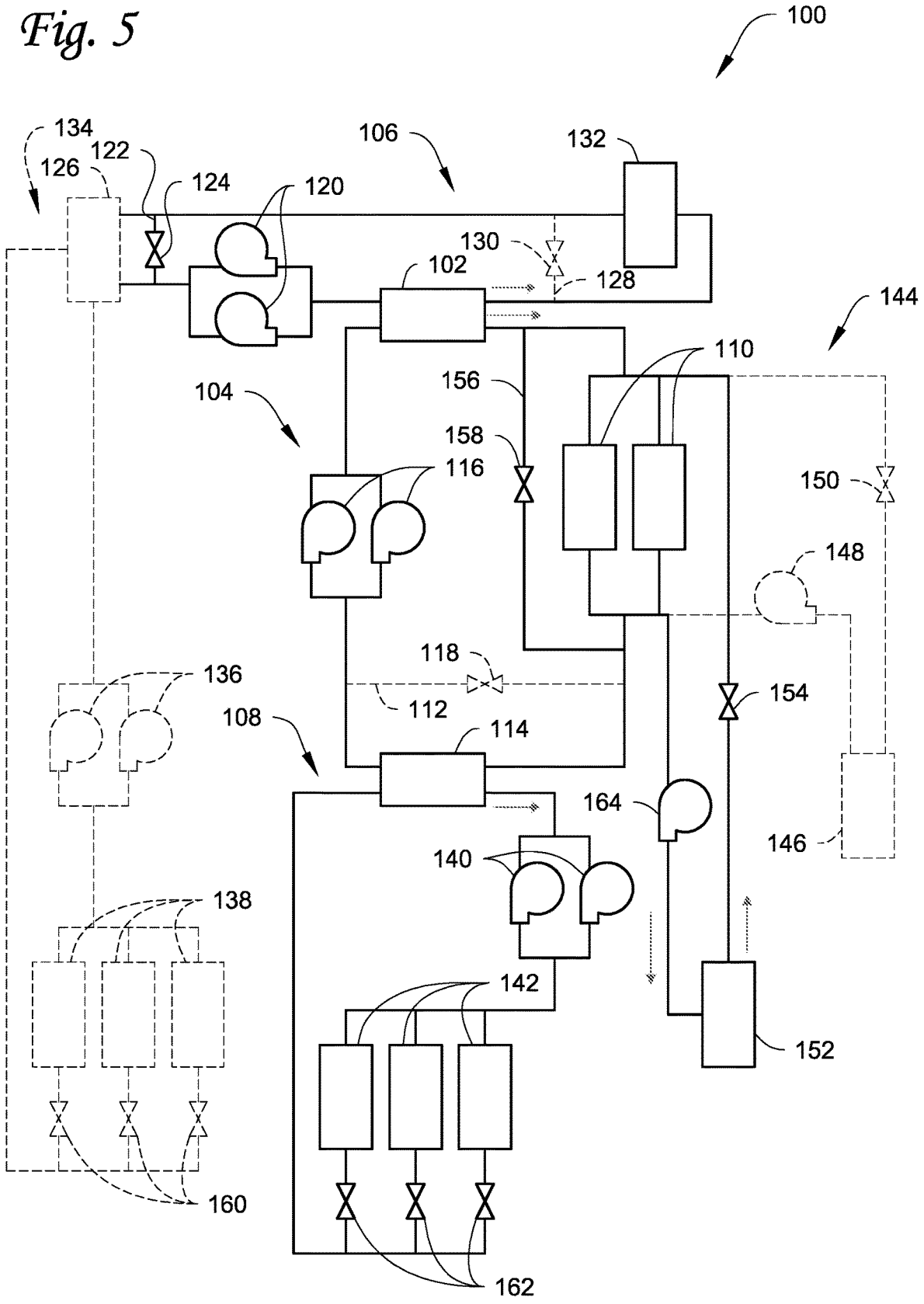
FIG. 5 shows a schematic of the storage source heat pump system of FIG. 1 in a cooling mode.

FIG. 5 shows a schematic of the storage source heat pump system of FIG. 1 in a cooling mode. The cooling mode shown in FIG. 5 can include cooling during summer or other periods where cooling is the dominant demand on the storage source heat pump system 100, where solid thermal storage material in thermal storage tanks 110 such as ice can be used to satisfy cooling demand or supplement cooling capacity. When in the cooling mode shown in FIG. 5, thermal system 102 can be operating to absorb energy from the storage circuit process fluid in storage fluid circuit 104 and rejecting energy to heating fluid circuit 106. In heating fluid circuit 106, cooling tower 132 is active, receiving heating process fluid which rejects energy to an ambient environment, while heat exchanger 126 is bypassed by way of bypass line 122 and bypass valve 124. Accordingly, heating system 134 does not receive energy from the heating fluid circuit 106. In storage fluid circuit 104, heat exchanger 114 is included. Depending on the state of the thermal storage material in thermal storage tanks 110, the thermal storage tanks 110 can also be included when they contain ice which can provide further cooling to the storage circuit process fluid. In at least some of the cooling operations shown in FIG. 5, a temperature of the storage circuit process fluid can be above a freezing point of the thermal storage material when it arrives at thermal storage tanks 110. At heat exchanger 114, storage circuit process fluid absorbs energy from the cooling process fluid of cooling circuit 108. The storage circuit process fluid has energy absorbed from it at thermal system 102, and can further have energy absorbed at thermal storage tanks 110. The operation of thermal system 102 can be set to achieve a desired temperature for the storage circuit process fluid that is based on cooling demand and/or an amount of cooling that can be achieved through the absorption of heat at the thermal storage tanks 110. Where there are latent cooling loads such as dehumidifiers active while in the cooling mode shown in FIG. 5, the optional DOAS coil 152 can be used to satisfy the latent cooling load while sensible cooling loads in the conditioned space are addressed by absorption of energy at cooling coils 142. The energy absorbed at cooling coils 142 can be rejected to the storage circuit process fluid at heat exchanger 114. In the cooling mode shown in FIG. 5, cooling demand can be met by mechanical cooling provided by thermal system 102 combined with any cooling that can be achieved through melting of the thermal storage material in thermal storage tanks 110. In the cooling mode shown in FIG. 5, the air source heat pump system 144 is not used, since thermal storage tanks 110 is used to absorb energy to support the cooling operation when possible. In an embodiment, the air source heat pump system 144 can be operated with air source heat pump, where air source heat pump 146 pumps energy out of the storage circuit process fluid and to the source.

Figure 6:
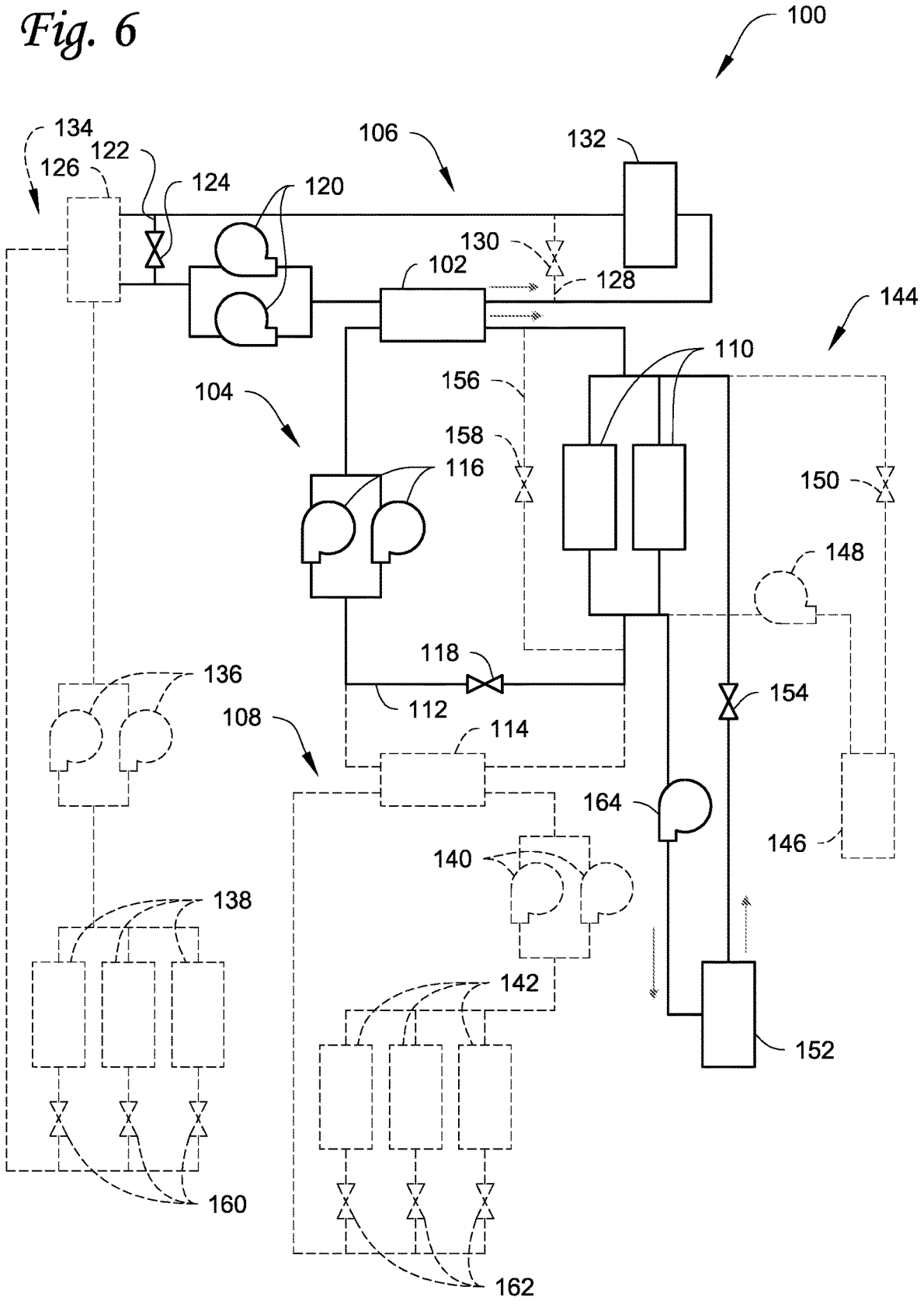
FIG. 6 shows a schematic of the storage source heat pump system in an energy rejection mode.

FIG. 6 shows a schematic of the storage source heat pump system in an energy rejection mode. The energy rejection mode shown in FIG. 6 can be used to produce additional solid thermal storage material in thermal storage tanks 110 such as ice for subsequent use to satisfy cooling demand or supplement cooling capacity, for example in subsequent operations according to the cooling mode shown in FIG. 5 and described above. The energy rejection mode shown in FIG. 6 can be used, for example, when cooling demand is expected to dominate but cooling is not required at a current time. For example, the energy rejection mode shown in FIG. 6 can be used overnight or early in mornings during summer times in temperate climates. In the energy rejection mode shown in FIG. 6, thermal system 102 can be operating to absorb energy from the storage circuit process fluid in storage fluid circuit 104 and rejecting energy to heating fluid circuit 106. In heating fluid circuit 106, cooling tower 132 is active, receiving heating process fluid which rejects heat to an ambient environment, while heat exchanger 126 is bypassed by way of bypass line 122 and bypass valve 124. Accordingly, heating system 134 does not receive energy from the heating fluid circuit 106. In storage fluid circuit 104, heat exchanger 114 is excluded even though energy is being absorbed from the storage circuit process fluid at thermal system 102. This can result in the storage circuit process fluid entering thermal storage tanks 110 at a temperature below the freezing point of the thermal storage material, thus freezing some of the thermal storage material in thermal storage tanks 110. In the energy rejection mode shown in FIG. 6, the air source heat pump system 144 is not used, since the energy rejection mode is directed to freezing the thermal storage material in thermal storage tanks 110. In an embodiment, the air source heat pump system 144 can be operated with air source heat pump 146 in a reverse mode, where air source heat pump 146 pumps energy out of the storage circuit process fluid and to the source.

The energy rejection mode shown in FIG. 6 allows thermal storage material to be frozen, allowing thermal storage tanks 110 to support subsequent cooling operations. This can allow efficient operations outside of peak demand to be stored for subsequently meeting peak cooling demand by the conditioned space. This can in turn allow a lower capacity thermal system to be used as the thermal system 102 compared to standard HVACR system designs, reducing cost and increasing the range of conditioned spaces that can be served by a thermal system. This can also allow peak energy consumption to be reduced, saving costs in variable-rate pricing systems and potentially even providing revenue in energy markets, while also reducing the HVACR system's impact on peak grid demand.

In operation, a typical heating day for storage source heat pump system 100 in a cold climate can include a heating peak, typically during the morning hours, for example between around 5:00 AM and around 10:00 AM. During the heating peak, the storage source heat pump system 100 can be operated in the heating mode, dedicated to transferring energy from thermal storage tanks 110 to heating circuit 106 by operation of thermal system 102. In this embodiment, the air source heat pump 146 may not be in operation during this heating peak period, with the electrical energy used by storage source heat pump system 100 being primarily directed to operation of thermal system 102. Outside of the heating peak, for example between around 11:00 AM and around 4:00 AM, the storage source heat pump system 100 can be operated to restore energy to thermal storage tanks 110, for example by operating at a lower load in the heating mode or the heating and cooling mode, while also operating air source heat pump 146 at a load greater than the load of thermal system 102. These operations can melt thermal storage material in thermal storage tanks 110, adding energy that can be used in the next heating peak. Thus, thermal energy stored in thermal storage tanks 110 can be used during the heating peak, and replenished during off-peak hours. In embodiments, the air source heat pump 146 can have a maximum capacity selected to allow thermal storage tanks 110 to be fully replenished between heating peaks for the building according to models or predictions of such typical heating days based on building size, ambient conditions such as temperature or solar intensity, building conditions such as insulation, and the like. The thermal storage tanks 110 can be sized and selected to provide sufficient storage capacity for the energy consumption during the heating peak, and optionally additional capacity as a safety margin for ensuring sufficient energy for operations.

Aspects

It is understood that any of aspects 1-11 can be combined with any of aspects 12-20.

Aspect 1. A heating, ventilation, air conditioning, and refrigeration (HVACR) system, comprising:

a heating fluid circuit configured to circulate a heating process fluid, a cooling fluid circuit configured to circulate a cooling process fluid, a storage fluid circuit configured to circulate a storage circuit process fluid including: one or more thermal storage tanks each containing a thermal storage material;

a heat exchanger allowing heat exchange between a storage circuit process fluid and a cooling circuit process fluid; and a bypass line configured to allow the heat exchanger to be selectively bypassed;

a thermal system, configured to absorb energy from the storage circuit process fluid and provide energy to the heating circuit process fluid; and a source heat exchange circuit including a heat pump configured to absorb energy from a source and provide energy to a source circuit process fluid, the source heat exchange circuit configured such that the heat pump exchanges heat with the one or more thermal storage tanks.

Aspect 2. The HVACR system according to aspect 1, wherein the thermal storage material is water and the storage circuit process fluid has a freezing temperature that is lower than a freezing temperature of water.

Aspect 3. The HVACR system according to any of aspects 1-2, wherein the source heat exchange circuit is directly connected to the storage fluid circuit and the source circuit process fluid includes a portion of the storage circuit process fluid.

Aspect 4. The HVACR system according to any of aspects 1-3, wherein the source heat exchange circuit includes one or more heat exchangers configured to allow exchange of heat between the source circuit process fluid and the thermal storage material in the one or more thermal storage tanks.

Aspect 5. The HVACR system according to any of aspects 1-4, wherein the storage fluid circuit is configured such that the source heat exchanger can be selectively included or excluded from a flow of the storage circuit process fluid.

Aspect 6. The HVACR system according to any of aspects 1-5, wherein the heating fluid circuit further comprises a cooling tower configured to allow the exchange of energy between the heating process fluid and an, the heating fluid circuit being configured to selectively include or exclude the cooling tower from a flow of the heating process fluid.

Aspect 7. The HVACR system according to any of aspects 1-6, wherein the storage fluid circuit further comprises one or more dedicated outdoor air system (DOAS) heat exchangers, wherein the one or more DOAS heat exchangers are each configured allow the exchange of energy between the storage circuit process fluid and a latent cooling load of the conditioned space, and the storage fluid circuit is configured to selectively include or exclude the one or more DOAS heat exchangers from a flow of the storage circuit process fluid.

Aspect 8. The HVACR system according to any of aspects 1-7, wherein the storage fluid circuit further comprises a bypass line configured to allow flow of the storage circuit process fluid to bypass the one or more thermal storage tanks, and a plurality of valves, the plurality of valves configured to control flow through each of the bypass line and the one or more thermal storage tanks.

Aspect 9. The HVACR system according to any of aspects 1-8, wherein the heat pump is configured to produce a leaving temperature of 60° F. or less when operated to provide energy to the source circuit process fluid.

Aspect 10. The HVACR system according to any of aspects 1-9, wherein the heat pump is configured to produce a leaving temperature of between 35° F. and 45° F. when operated to provide energy to the source circuit process fluid.

Aspect 11. The HVACR system according to any of aspects 1-10, further comprising at least one of:

a heat exchanger configured to exchange heat between building waste water and one or more of the thermal storage tanks, or a solar collector configured to provide energy to one or more of the thermal storage tanks.

Aspect 12. A method of adjusting air temperatures in a conditioned space, comprising:

operating a heating, ventilation, air conditioning, and refrigeration (HVACR) system in one of a heating mode, a heating and cooling mode, or an energy storage mode, or an energy rejection mode, wherein:

operating in heating mode comprises:

operating a thermal system to absorb energy from a storage circuit process fluid of a storage fluid circuit and provide energy to a heating process fluid, the storage fluid circuit including one or more thermal storage tanks each containing a thermal storage material; and rejecting energy to the conditioned space at one or more heating coils, operating in the heating and cooling mode comprises:

operating the thermal system to absorb energy from the storage circuit process fluid and provide energy to the heating process fluid;

rejecting energy to the conditioned space at the one or more heating coils, exchanging heat between the storage circuit process fluid and a cooling process fluid; and absorbing energy from the conditioned space to the cooling process fluid at one or more cooling coils, operating in the energy storage mode comprises exchanging heat between the storage circuit process fluid and the cooling process fluid, wherein the cooling process fluid absorbs energy from the conditioned space at the one or more cooling coils and rejects heat to the thermal storage material at the one or more storage tanks, and operating a heat pump to absorb energy from a source, and providing the energy absorbed from the source to the one or more thermal storage tanks.

Aspect 13. The method according to aspect 12, wherein operating the heat pump results in a leaving temperature at the heat pump of 60° F. or less.

Aspect 14. The method according to any of aspects 12-13, wherein operating the heat pump results in a leaving temperature at the heat pump of between 35° F. and 45° F.

Aspect 15. The method according to any of aspects 12-14, further comprising adding energy to the thermal storage tank by one or more of absorbing energy from waste water from the conditioned space or absorbing energy from a solar collector.

Aspect 16. The method according to any of aspects 12-15, wherein operating the heat pump is performed simultaneously with operating in one of the heating mode, the heating and cooling mode, or the energy storage mode.

Aspect 17. The method of claim 12, wherein operating the heat pump is performed based on an availability of energy and a capacity of the thermal storage tanks.

Aspect 18. The method according to any of aspects 12-17, wherein the energy absorbed from the source is provided solely to the thermal storage tanks.

Aspect 19. The method according to any of aspects 12-18, wherein operating the heat pump adds the energy absorbed from the source to at least a portion of the storage circuit process fluid.

Aspect 20. The method according to any of aspects 12-19, wherein operating the heat pump adds the energy absorbed from the source to a source circuit process fluid, and the providing of the energy to the one or more thermal storage tanks includes exchanging heat between the source circuit process fluid and the thermal storage material.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating, ventilation, air conditioning, and refrigeration (HVACR) system, comprising:

a heating fluid circuit configured to circulate a heating process fluid;

a cooling fluid circuit configured to circulate a cooling process fluid, a storage fluid circuit configured to circulate a storage circuit process fluid including:

one or more thermal storage tanks each containing a thermal storage material;

a heat exchanger allowing heat exchange between the storage circuit process fluid and the cooling process fluid; and a bypass line configured to allow the heat exchanger to be selectively bypassed;

a thermal system, configured to absorb energy from the storage circuit process fluid and provide energy to the heating process fluid; and a source heat exchange circuit including a heat pump configured to absorb energy from a source and provide energy to a source circuit process fluid, the source heat exchange circuit configured such that the heat pump exchanges heat with the one or more thermal storage tanks.

2. The HVACR system of claim 1, wherein the thermal storage material is water and the storage circuit process fluid has a freezing temperature that is lower than a freezing temperature of water.

3. The HVACR system of claim 1, wherein the source heat exchange circuit is directly connected to the storage fluid circuit and the source circuit process fluid includes a portion of the storage circuit process fluid.

4. The HVACR system of claim 1, wherein the source heat exchange circuit includes one or more heat exchangers configured to allow exchange of heat between the source circuit process fluid and the thermal storage material in the one or more thermal storage tanks.

5. The HVACR system of claim 1, wherein the storage fluid circuit is configured such that the source heat exchange circuit can be selectively included or excluded from a flow of the storage circuit process fluid.

6. The HVACR system of claim 1, wherein the heating fluid circuit further comprises a cooling tower configured to allow the exchange of energy between the heating process fluid and an ambient environment, the heating fluid circuit being configured to selectively include or exclude the cooling tower from a flow of the heating process fluid.

7. The HVACR system of claim 1, wherein the storage fluid circuit further comprises one or more dedicated outdoor air system (DOAS) heat exchangers, wherein the one or more DOAS heat exchangers are each configured allow the exchange of energy between the storage circuit process fluid and a latent cooling load of a conditioned space, and the storage fluid circuit is configured to selectively include or exclude the one or more DOAS heat exchangers from a flow of the storage circuit process fluid.

8. The HVACR system of claim 1, wherein the storage fluid circuit further comprises a bypass line configured to allow flow of the storage circuit process fluid to bypass the one or more thermal storage tanks, and a plurality of valves, the plurality of valves configured to control flow through each of the bypass line and the one or more thermal storage tanks.

9. The HVACR system of claim 1, wherein the heat pump is configured to produce a leaving temperature of 60° F. or less when operated to provide energy to the source circuit process fluid.

10. The HVACR system of claim 1, wherein the heat pump is configured to produce a leaving temperature of between 35° F. and 45° F. when operated to provide energy to the source circuit process fluid.

* * * * *